US009855959B2

(12) United States Patent
Nishimura et al.

(10) Patent No.: US 9,855,959 B2
(45) Date of Patent: Jan. 2, 2018

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 156 days.

(21) Appl. No.: 14/787,025

(22) PCT Filed: Apr. 14, 2014

(86) PCT No.: PCT/JP2014/002104
§ 371 (c)(1),
(2) Date: Oct. 26, 2015

(87) PCT Pub. No.: WO2014/174788
PCT Pub. Date: Oct. 30, 2014

(65) Prior Publication Data

US 2016/0075352 A1 Mar. 17, 2016

(30) Foreign Application Priority Data

Apr. 24, 2013 (JP) ..... 2013-091157

(51) Int. Cl.
*B61F 5/16* (2006.01)
*B61F 5/14* (2006.01)
(Continued)

(52) U.S. Cl.
CPC ..... *B61F 5/16* (2013.01); *B61F 3/02* (2013.01); *B61F 5/14* (2013.01); *B61F 5/302* (2013.01); *B61F 5/52* (2013.01)

(58) Field of Classification Search
CPC ..... B61F 5/14; B61F 5/16; B61F 5/24
(Continued)

(56) References Cited

U.S. PATENT DOCUMENTS 4,134,343 A * 1/1979 Jackson ..... B61F 3/08 105/167
4,760,799 A * 8/1988 Jackson ..... B61F 5/24 105/182.1
(Continued)

FOREIGN PATENT DOCUMENTS

CN 202186399 U 4/2012
JP H02-33167 U 3/1990
(Continued)

OTHER PUBLICATIONS

Jul. 8, 2014 International Search Report issued in International Patent Application No. PCT/JP2014/002104.
(Continued)

*Primary Examiner* — Zachary L Kuhfuss
(74) *Attorney, Agent, or Firm* — Oliff PLC

(57) ABSTRACT

A railcar bogie includes: a bogie frame including a cross beam and plate springs and being rotatable relative to a bolster in a yawing direction, the cross beam extending in a car width direction, the plate springs supporting both respective car width direction end portions of the cross beam and extending in a car longitudinal direction; and stoppers provided at the bogie frame and configured to contact interference members to restrict a rotation range of the bogie frame when the bogie frame rotates relative to the bolster in the yawing direction, the interference members being connected to the bolster. When the bogie frame is located at a neutral position relative to the bolster in the yawing direction, the stoppers are arranged at car width direction lateral sides of the cross beam so as to overlap the cross beam in a side view.

11 Claims, 9 Drawing Sheets

(51) Int. Cl.
*B61F 5/52* (2006.01)
*B61F 5/30* (2006.01)
*B61F 3/02* (2006.01)

(58) Field of Classification Search
USPC ..... 105/198.2, 198.4, 198.5
See application file for complete search history.

(56) References Cited

U.S. PATENT DOCUMENTS 5,107,773 A * 4/1992 Daley ..... B61F 5/14 105/185
6,305,297 B1 10/2001 Landrot
6,338,300 B1 1/2002 Landrot
2012/0037031 A1* 2/2012 Okubo ..... B61F 5/386 105/167
2016/0082985 A1* 3/2016 Nishimura ..... B61F 3/04 105/197.05

FOREIGN PATENT DOCUMENTS

JP H04-45982 Y2 10/1992
JP H06-40051 Y2 10/1994
JP 2002-046603 A 2/2002
JP 2012-116279 A 6/2012

OTHER PUBLICATIONS

Oct. 27, 2015 International Preliminary Report on Patentability issued in International Patent Application No. PCT/JP2014/002104.
Oct. 27, 2016 Office Action issued in Chinese Patent Application No. 201480021403.2.

* cited by examiner

RAILCAR BOGIE

TECHNICAL FIELD

The present invention relates to a bogie supporting a carbody of a railcar.

BACKGROUND ART

A bogie for supporting a carbody of a railcar and allowing the railcar to travel along a rail is provided under a floor of the carbody. One type of the bogie includes: a bolster attached to the carbody; and a bogie frame supporting the bolster from below, and the bogie frame rotates relative to the bolster in a yawing direction when, for example, the railcar travels along a curved line.

PTL 1 discloses a bogie configured such that: cushion rubber as a stopper is attached to a cross beam of a bogie frame so as to be located in a space between left and right side sills of the bogie frame; and the cushion rubber contacts and interferes with a traction beam to restrict the displacement of the traction beam in a leftward/rightward direction.

CITATION LIST

Patent Literature

PTL 1: Japanese Examined Utility Model Application Publication No. 2-33167

SUMMARY OF INVENTION

Technical Problem

In the bogie configured such that the bogie frame rotates relative to the bolster, the stopper which restricts a rotation range of the bogie frame may be provided at the bogie frame. However, as in PTL 1, when the stopper (for example, the cushion rubber) is provided in the space between the left and right side sills of the bogie, a car width direction inner space of the bogie is occupied by the stopper and the like, so that the degree of freedom of the layout of the other parts is limited. The stopper may receive a contact load generated by the interference of the stopper with an opponent member (for example, the bolster), the stopper rotating relative to the opponent member. Therefore, from the viewpoint of the balance and strength of the bogie, there is still room for improvement regarding the arrangement of the stopper.

An object of the present invention is to improve a space efficiency of a bogie and compactly configure the bogie while maintaining balance and strength of the bogie in a car longitudinal direction.

Solution to Problem

A railcar bogie according to the present invention is a bogie supporting a carbody of a railcar, the bogie including: a bogie frame including a cross beam and side members and being rotatable relative to the carbody in a yawing direction, the cross beam extending in a car width direction, the side members supporting both respective car width direction end portions of the cross beam and extending in a car longitudinal direction; and a stopper provided at the bogie frame and configured to contact an interference member to restrict a rotation range of the bogie frame when the bogie frame rotates relative to the carbody in the yawing direction, the interference member being connected to the carbody, when the bogie frame is located at a neutral position relative to the carbody in the yawing direction, the stopper being arranged at a car width direction lateral side of the cross beam so as to overlap the cross beam in a side view.

According to the above configuration, since the stopper is arranged at the car width direction lateral side of the cross beam, a car width direction inner space of the bogie can be efficiently utilized for the layout of the other parts. Therefore, the space efficiency can be improved. In this configuration, the stopper is arranged so as to overlap the cross beam in a side view. With this, the stopper can be provided close to the cross beam located at a center in the car longitudinal direction. Thus, the bogie can be compactly configured while maintaining the balance and strength of the bogie. For example, when fixing the stopper to the cross beam, a portion from a contact surface of the stopper until the cross beam can be prevented from becoming long in the car longitudinal direction, and the requirement of the strength of the stopper can be relaxed.

Advantageous Effects of Invention

As is clear from the above explanation, the present invention can improve the space efficiency of the bogie and compactly configure the bogie while maintaining the balance of the bogie in the car longitudinal direction.

DESCRIPTION OF EMBODIMENTS

Figure 1:
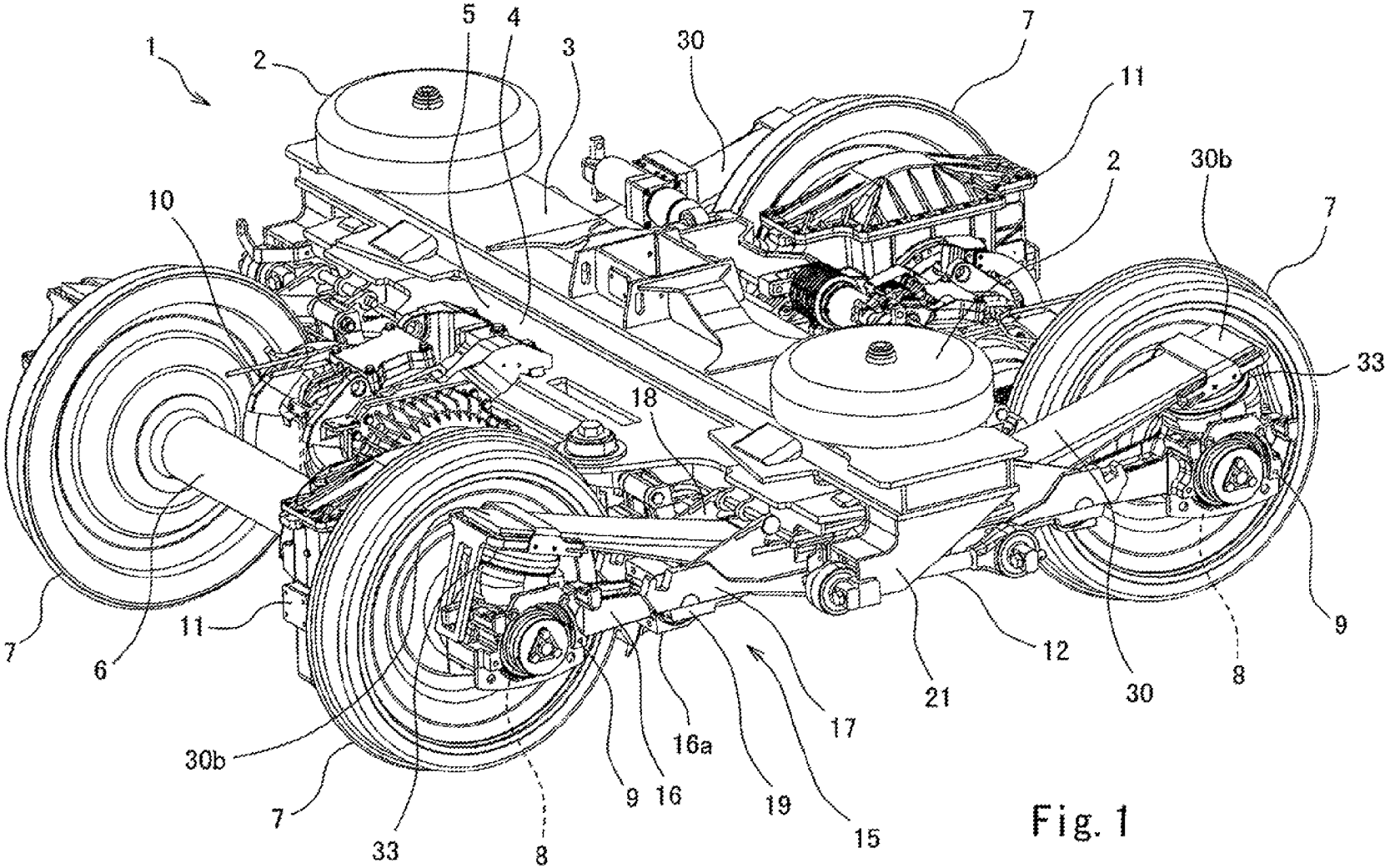
FIG. 1 is a perspective view showing a railcar bogie according to a first embodiment.

Hereinafter, embodiments will be explained in reference to the drawings. In the following explanations, each of a direction in which a railcar travels and a length direction in which a carbody extends is defined as a car longitudinal direction, and a lateral direction perpendicular to the car longitudinal direction is defined as a car width direction (in the embodiments, the car longitudinal direction is also referred to as a forward/rearward direction, and the car width direction is also referred to as a leftward/rightward direction). In the drawings, the same reference signs are used for the same components.

First Embodiment

Figure 2:
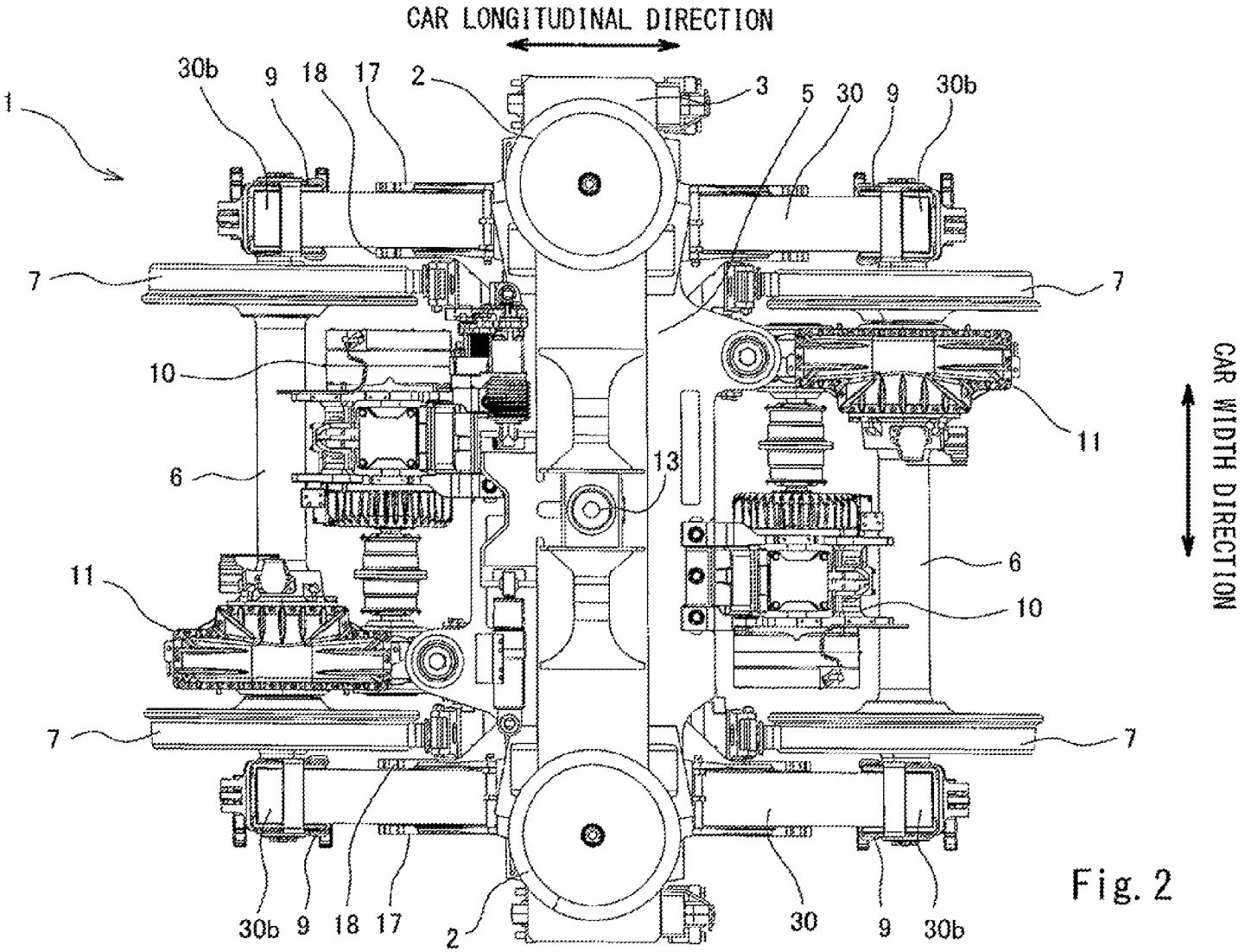
FIG. 2 is a plan view of the bogie shown in FIG. 1.

FIG. 1 is a perspective view showing a railcar bogie 1 according to the first embodiment. FIG. 2 is a plan view of the bogie 1 shown in FIG. 1. As shown in FIGS. 1 and 2, the railcar bogie 1 includes a bolster 3 and a bogie frame 4. The bolster 3 is attached to a carbody (not shown) via air springs 2 serving as secondary suspensions and supports the carbody. The bogie frame 4 supports the bolster 3 so as to be rotatable relative to the bolster 3 in a yawing direction. The bolster 3 is located at a car longitudinal direction middle portion of the bogie 1 and extends in the car width direction. The air springs 2 are arranged at respective upper surfaces of left and right end portions of the bolster 3. The bogie frame 4 includes a cross beam 5 and plate springs 30 (side members). The cross beam 5 extends in the car width direction that is the leftward/rightward direction and supports the carbody. The plate springs 30 (side members) support both respective car width direction end portions of the cross beam 5 from below and extend in the car longitudinal direction.

The cross beam 5 is turnably connected to the bolster 3 via a turn guide mechanism 13. The bolster 3 is connected to the carbody (not shown) via the air springs 2 and bolster anchors 12. In the present embodiment, the turn guide mechanism 13 includes a concave portion 13*a* and a convex portion 13*b*. The concave portion 13*a* is formed on an upper surface of a center portion of the cross beam 5, and the convex portion 13*b* projects from a lower surface 3*b* of a center portion of the bolster 3 and is rotatably fitted to the concave portion 13*a*. A locking tool (for example, a locking pin) is attached to the turn guide mechanism 13. The locking tool prevents the convex portion 13*b* from being detached from the concave portion 13*a* in a vertical direction. Front and rear axles 6 extending along the car width direction are arranged in front of and behind the cross beam 5, respectively. Wheels 7 are fixed to both respective car width direction sides of each axle 6. Bearings 8 are provided at both respective car width direction end portions of each axle 6 so as to be located outside the wheels 7 in the car width direction. The bearings 8 rotatably support the axles 6. The bearings 8 are accommodated in respective axle boxes 9. Electric motors 10 are attached to the cross beam 5, and reducers 11 which transmit power to the respective axles 6 are connected to respective output shafts of the electric motors 10.

Each of the plate springs 30 extending in the car longitudinal direction is provided between the cross beam 5 and the axle box 9. Longitudinal direction middle portions 30*a* (see FIG. 7) of the plate springs 30 support both respective car width direction end portions of the cross beam 5 from below. Both longitudinal direction end portions 30*b* of each of the plate springs 30 are supported by the respective axle boxes 9. To be specific, each of the plate springs 30 serves as both a primary suspension and a conventional side sill. The plate springs 30 are made of, for example, fiber-reinforced resin, and the middle portions 30*a* (see FIG. 7) of the plate springs 30 are arranged under the cross beam 5. Pressing members 31 (see FIG. 7) are provided under the respective car width direction end portions of the cross beam 5. Each of the pressing members 31 is provided between a pair of receiving seats 17 and 18 and has a lower surface formed in a circular-arc shape in a side view. The pressing members 31 are disposed on the respective middle portions 30*a* of the plate springs 30 from above. To be specific, the pressing members 31 press respective upper surfaces of the plate springs 30 downward by a carbody load so as not to fix the plate springs 30 in an upper/lower direction, the carbody load being transmitted from the cross beam 5. The pressing member 31 is formed by a rigid member (for example, metal or fiber-reinforced resin).

Spring seats 33 are attached to respective upper portions of the axle boxes 9. The end portions 30*b* of the plate springs 30 are disposed on the respective spring seats 33 from above. To be specific, the end portions 30*b* of each of the plate springs 30 are supported by the respective axle boxes 9 via the respective spring seats 33. The spring seats 33 support both respective end portions 30*b* of each of the plate springs 30 such that upper surfaces of the end portions 30*b* of each of the plate springs 30 are inclined in a direction toward the middle portion 30*a*. The middle portion 30*a* of the plate spring is pressed by the lower surface of the pressing member 31 (see FIG. 7) to have a circular-arc shape. To be specific, the middle portion 30*a* is located under the end portions 30*b*, and the entire plate spring 30 has a bow shape that is convex downward in a side view.

The axle boxes 9 are coupled to the car width direction end portions of the cross beam 5 by coupling devices 15 constituting axle box suspensions. Each of the coupling devices 15 includes axle beams 16, a pair of receiving seats 17 and 18, and coupling portions 19. Each of the axle beams 16 projects integrally from the axle box 9 toward the cross beam 5. The receiving seats 17 and 18 project from the cross beam 5 toward the axle beams 16. Each of the coupling portions 19 includes a rubber bushing or the like (not shown) and elastically couples a tip end portion 16*a* of the axle beam 16 to the receiving seats 17 and 18 and To be specific, the coupling device 15 of the present embodiment is an axle beam type device.

Figure 3:
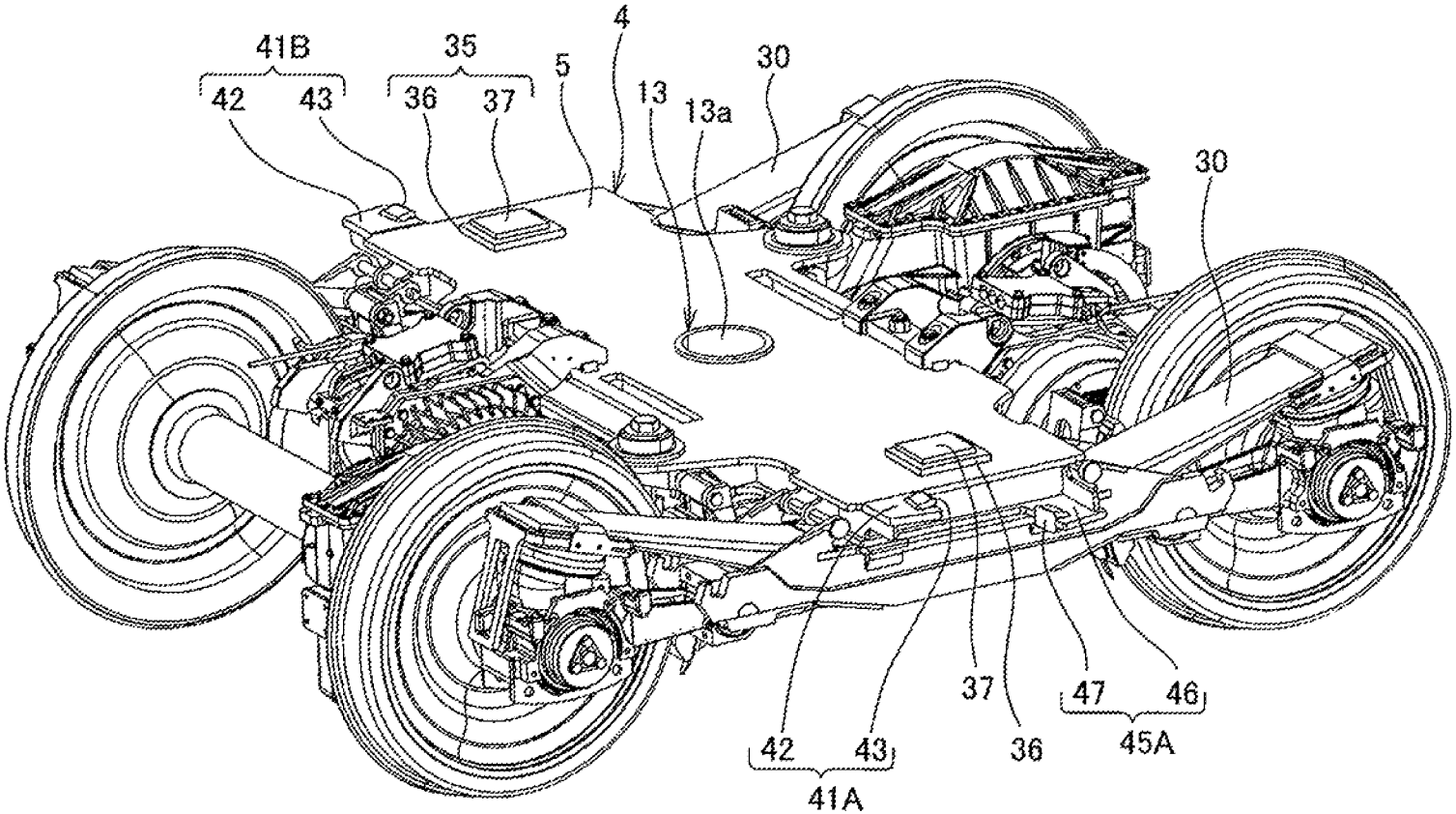
FIG. 3 is a perspective view showing a state where a bolster is detached from the bogie shown in FIG. 1.
Figure 4:
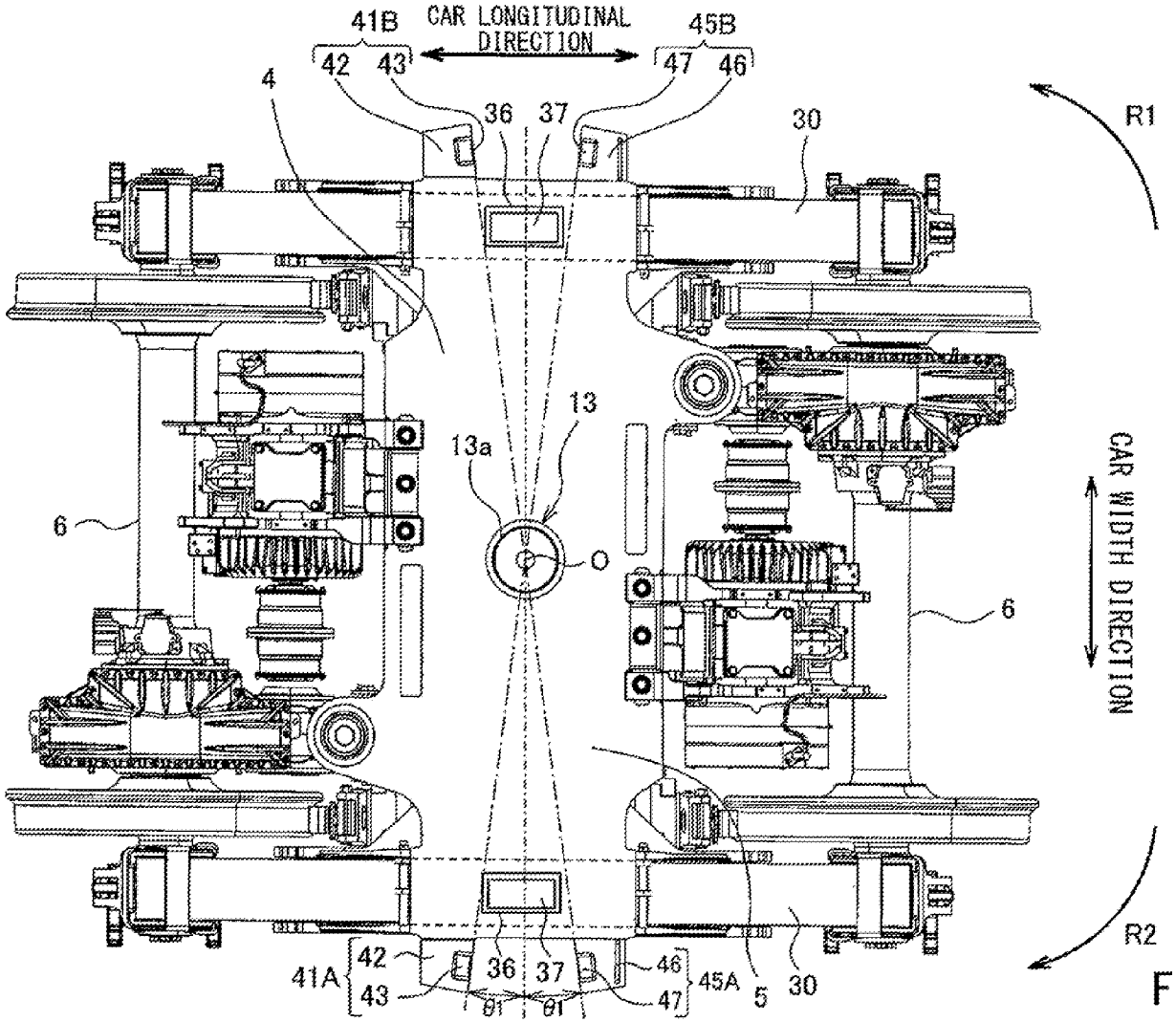
FIG. 4 is a plan view of the bogie shown in FIG. 3.

FIG. 3 is a perspective view showing a state where the bolster 3 is detached from the bogie 1 shown in FIG. 1. FIG. 4 is a plan view of the bogie shown in FIG. 3. As shown in FIGS. 3 and 4, rubbing plate units 35 are provided on respective upper surfaces of both car width direction end portions of the cross beam 5 of the bogie frame 4. Each of the rubbing plate units 35 includes: a receiving member 36 fixed to an upper surface of the cross beam 5; and a rubbing plate 37 accommodated in a concave portion formed on an upper surface of the receiving member 36. The rubbing plate 37 projects upward from the receiving member 36. In a plan view, the rubbing plate 37 is arranged within a region where the cross beam 5 and the plate spring 30 intersect with each other and is also arranged on a center line of the plate spring 30, the center line extending in the car longitudinal direction.

A first stopper 41A and a second stopper 45A are fixed to one of the car width direction end portions of the cross beam 5. The first stopper 41A restricts a rotation range of the bogie frame 4 when the bogie frame 4 rotates relative to the bolster 3 toward a first rotation side R1 of the yawing direction. The second stopper 45A restricts the rotation range of the bogie frame 4 when the bogie frame 4 rotates relative to the bolster 3 toward a second rotation side R2 of the yawing direction. A third stopper 41B and a fourth stopper 45B are fixed to the other car width direction end portion of the cross beam 5. The fourth stopper 45B restricts the rotation range of the bogie frame 4 when the bogie frame 4 rotates relative to the bolster 3 toward the first rotation side R1 of the yawing direction. The third stopper 41B restricts the rotation range of the bogie frame 4 when the bogie frame 4 rotates relative to the bolster 3 toward the second rotation side R2 of the yawing direction.

Each of the first stopper 41A and the third stopper 41B projects toward a car width direction outer side from a portion of the car width direction end portion of the cross beam 5, the portion being located at a first side in the car longitudinal direction. Each of the second stopper 45A and the third stopper 45B projects toward the car width direction outer side from a portion of the car width direction end portion of the cross beam 5, the portion being located at a second side in the car longitudinal direction. The first stopper 41A and the third stopper 41B are arranged above the second stopper 45A and the fourth stopper 45B. In a plan view, the first to fourth stoppers 41A, 41B, 45A, and 45B are arranged within a range of a car longitudinal direction length of the cross beam 5.

Each of the first stopper 41A and the third stopper 41B includes a base portion 42 and a contact portion 43. The base portion 42 projects from the cross beam 5 toward the car width direction outer side. The contact portion 43 is provided at the second side of the base portion 42 in the car longitudinal direction and includes a contact surface facing the second side in the car longitudinal direction. Each of the second stopper 45A and the fourth stopper 45B includes a plate-shaped base portion 46 and a contact portion 47. The base portion 46 projects from the cross beam 5 toward the car width direction outer side. The contact portion 47 is provided at the first side of the base portion 46 in the car longitudinal direction and includes a contact surface facing the first side in the car longitudinal direction. Each of the contact surfaces of the contact portions 43 and 47 is a surface perpendicular to a horizontal direction. Each of the base portions 42 and 46 is a horizontal plate projecting from the cross beam 5 toward the car width direction outer side. Upper surfaces of the base portions 42 are flush with an upper surface of the cross beam 5, and lower surfaces of the base portions 46 are flush with a lower surface of the cross beam 5.

In a plan view, each of the contact surfaces of the contact portions 43 of the first and third stoppers 41A and 41B is formed so as to include a surface parallel to a virtual line inclined toward one side at a predetermined angle θ1 relative to a center line extending through a turning center O of the bogie frame 4 and parallel to the car width direction. In a plan view, each of the contact surfaces of the contact portions 47 of the second and fourth stoppers 45A and 45B is formed so as to include a surface parallel to a virtual line inclined toward the other side at the predetermined angle θ1 relative to the center line extending through the turning center O of the bogie frame 4 and parallel to the car width direction. To be specific, in a plan view, the contact surfaces of the contact portions 43 and 47 of the first and second stoppers 41A and 45A includes respective surfaces which are inclined relative to the car width direction such that a distance between these surfaces increases as the surfaces extend toward the car width direction outer side. The contact surfaces of the contact portions 43 and 47 of the third and fourth stoppers 41B and 45B are similarly formed. At least the base portions 42 and 46 of the first to fourth stoppers 41A, 41B, 45A, and 45B are made of a rigid material, such as metal or fiber-reinforced resin. At least the contact surfaces of the contact portions 43 and 47 may be made of an elastic material, such as rubber.

Figure 5:
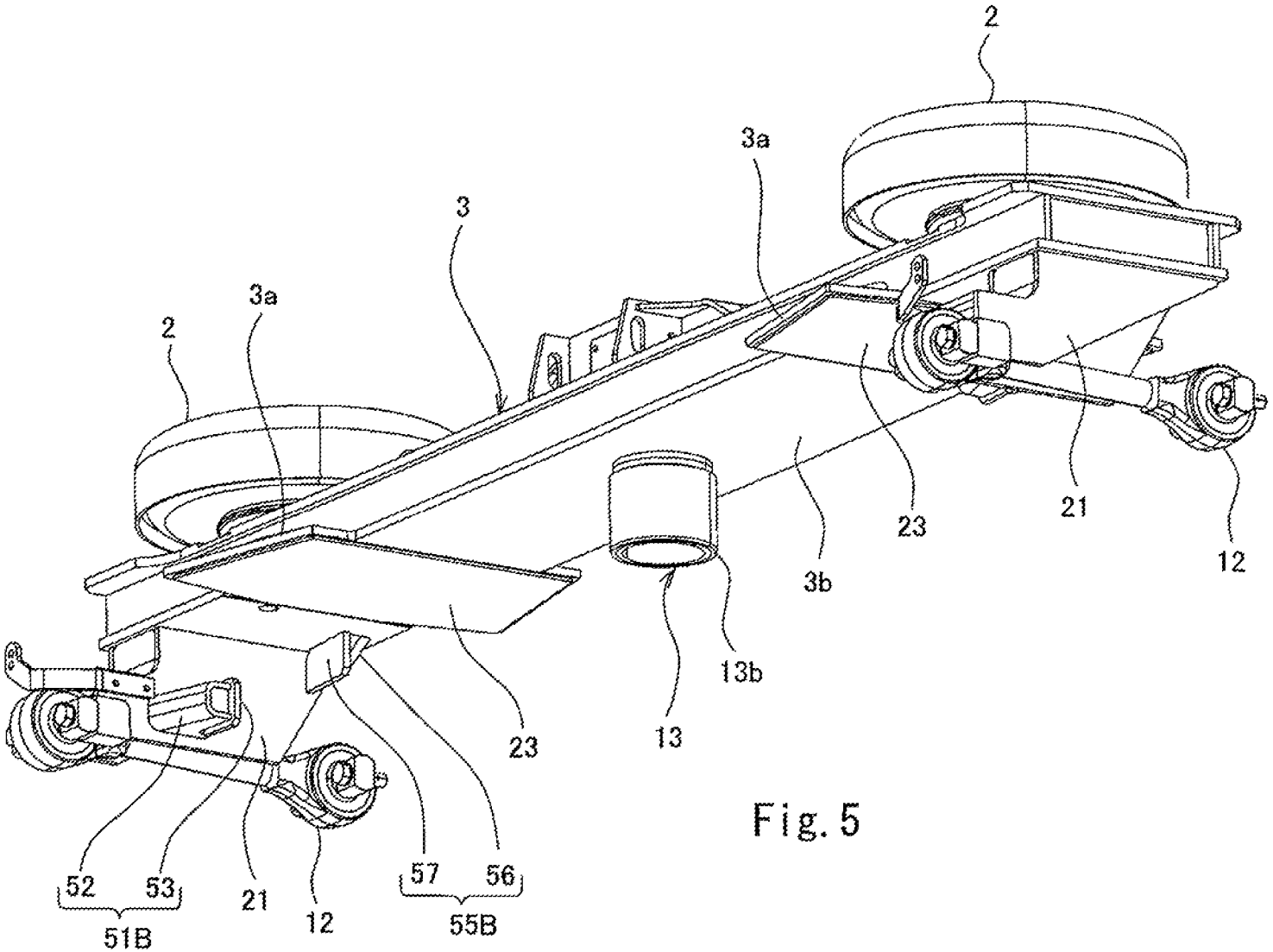
FIG. 5 is a perspective view of the bolster of FIG. 1 when viewed from an obliquely lower side.
Figure 6:
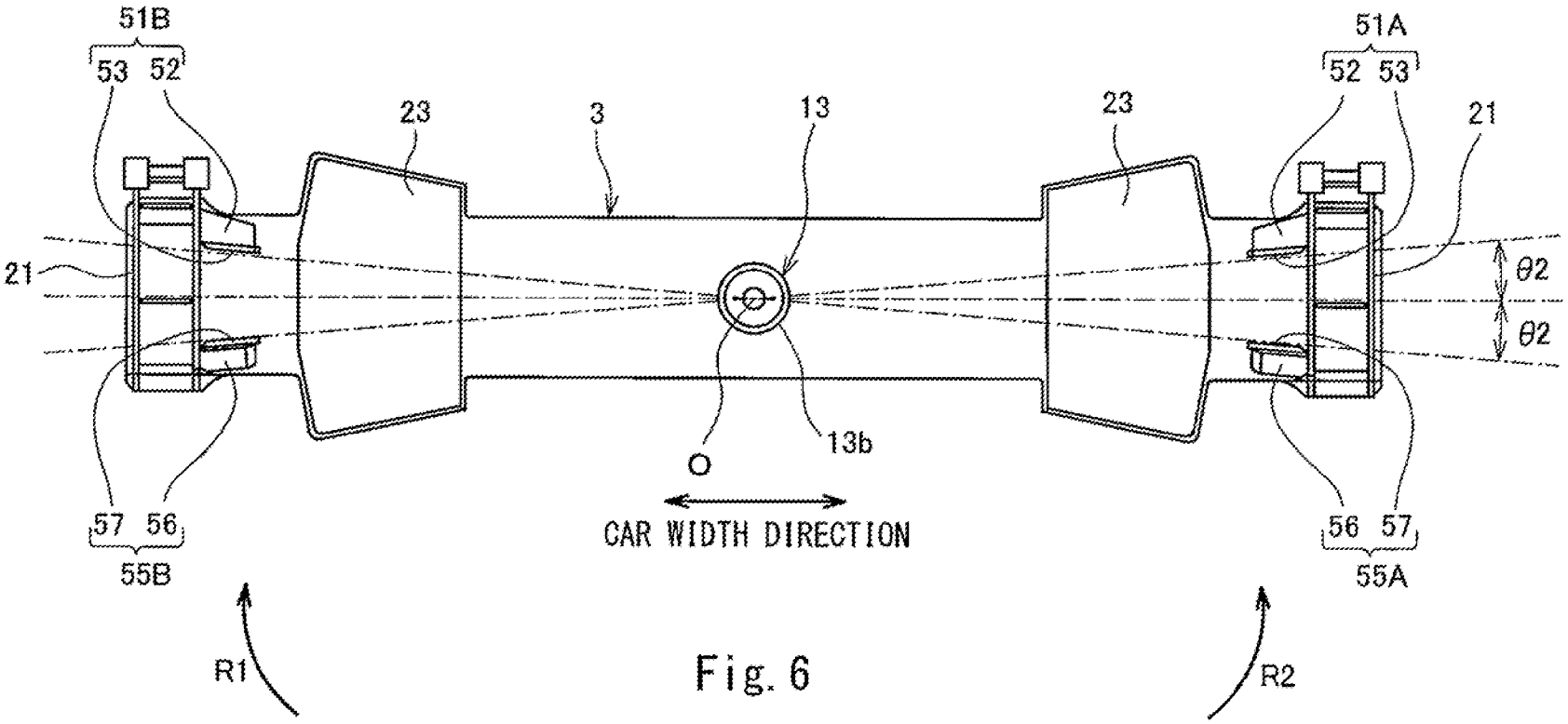
FIG. 6 is a bottom view of the bolster of FIG. 5 when viewed from below.

FIG. 5 is a perspective view of the bolster 3 of FIG. 1 when viewed from an obliquely lower side. FIG. 6 is a bottom view of the bolster 3 of FIG. 5 when viewed from below. As shown in FIGS. 5 and 6, brackets 21 projecting downward are provided at both respective car width direction end portions of the bolster 3. The bolster anchors 12 which connect the carbody (not shown) with the bolster 3 are attached to the respective brackets 21. The bolster 3 includes projecting portions 3*a* each projecting toward both sides in the car longitudinal direction such that a lower surface of the bolster 3 partially expands in the car longitudinal direction at a position opposing the rubbing plate 37 (see FIG. 3). Rubbed plates 23 are attached to respective lower surfaces of both end portions of the bolster 3. The rubbed plates 23 slidingly contact the respective rubbing plates 37 (see FIG. 3).

A first interference member 51A and a second interference member 55A are provided at a car width direction inner side of the bracket 21 provided at one of car width direction sides of the bolster 3. The first interference member 51A contacts the first stopper 41A to restrict the rotation range of the bogie frame 4 when the bogie frame 4 rotates relative to the bolster 3 toward the first rotation side R1 of the yawing direction. The second interference member 55A contacts the second stopper 45A to restrict the rotation range of the bogie frame 4 when the bogie frame 4 rotates relative to the bolster 3 toward the second rotation side R2 of the yawing direction. A fourth interference member 55B and a third interference member 51B are provided at a car width direction inner side of the bracket 21 provided at the other car width direction side of the bolster 3. The fourth interference member 55B contacts the fourth stopper 45B to restrict the rotation range of the bogie frame 4 when the bogie frame 4 rotates relative to the bolster 3 toward the first rotation side R1 of the yawing direction. The third interference member 51B contacts the third stopper 41B to restrict the rotation range of the bogie frame 4 when the bogie frame 4 rotates relative to the bolster 3 toward the second rotation side R2 of the yawing direction.

Each of the first interference member 51A and the third interference member 51B projects toward the car width direction inner side from a portion of the bracket 21 of the bolster 3, the portion being located at the first side in the car longitudinal direction. Each of the second interference member 55A and third interference member 55B projects toward the car width direction inner side from a portion of the bracket 21 of the bolster 3, the portion being located at the second side in the car longitudinal direction. The first interference member 51A and the third interference member 51B are arranged under the second interference member 55A and the fourth interference member 55B. In a plan view, the first to fourth interference members 51A, 51B, 55A, and 55B are arranged under the bolster 3 so as to overlap the bolster 3.

Each of the first interference member 51A and the third interference member 51B includes a base portion 52 and a contact portion 53. The base portion 52 projects from the bracket 21 toward the car width direction inner side. The contact portion 53 is provided at the second side of the base portion 52 in the car longitudinal direction and includes a contact surface facing the second side in the car longitudinal direction. Each of the second interference member 55A and the fourth interference member 55B includes a base portion 56 and a contact portion 57. The base portion 56 projects from the bracket 21 toward the car width direction inner side. The contact portion 57 is provided at the first side of the base portion 56 in the car longitudinal direction and includes a contact surface facing the first side in the car longitudinal direction. Each of upper surfaces of the base portions 52 of the first and third interference members 51A and 51B includes a horizontal surface. The base portions 52 of the first and third interference members 51A and 51B are thicker than the base portions 56 of the second and fourth interference members 55A and 55B. Each of the contact surfaces of the contact portions 53 and 57 is a surface perpendicular to the horizontal direction. In a plan view, each of the contact surfaces of the contact portions 53 of the first and third interference members 51A and 51B is formed so as to include a surface parallel to a virtual line inclined toward one side at a predetermined angle θ2 relative to the center line extending through the turning center O of the bogie frame 4 and parallel to the car width direction. In a plan view, each of the contact surfaces of the contact portions 57 of the second and fourth interference members 55A and 55B is formed so as to include a surface parallel to a virtual line inclined toward the other side at the predetermined angle θ2 relative to the center line extending through the turning center O of the bogie frame 4 and parallel to the car width direction. The predetermined angle θ2 may be the same as or different form the predetermined angle θ1.

At least the base portions 52 and 56 of the first to fourth interference members 51A, 51B, 55A, and 55B are made of a rigid material, such as metal or fiber-reinforced resin. It is preferable that at least the contact surfaces of the contact portions 53 and 57 of the first to fourth interference members 51A, 51B, 55A, and 55B be made of an elastic material, such as rubber. However, the contact surfaces of the contact portions 53 and 57 of the first to fourth interference members 51A, 51B, 55A, and 55B may be made of a rigid material. To be specific, at least one of a group of the contact surfaces of the first to fourth stoppers 41A, 41B, 45A, and 45B and a group of the contact surfaces of the first to fourth interference members 51A, 51B, 55A, and 55B may be made of the elastic material. The configuration and arrangement of the first to fourth stoppers 41A, 41B, 45A, and 45B and the configuration and arrangement of the first to fourth interference members 51A, 51B, 55A, and 55B may be replaced with each other.

Figure 7:
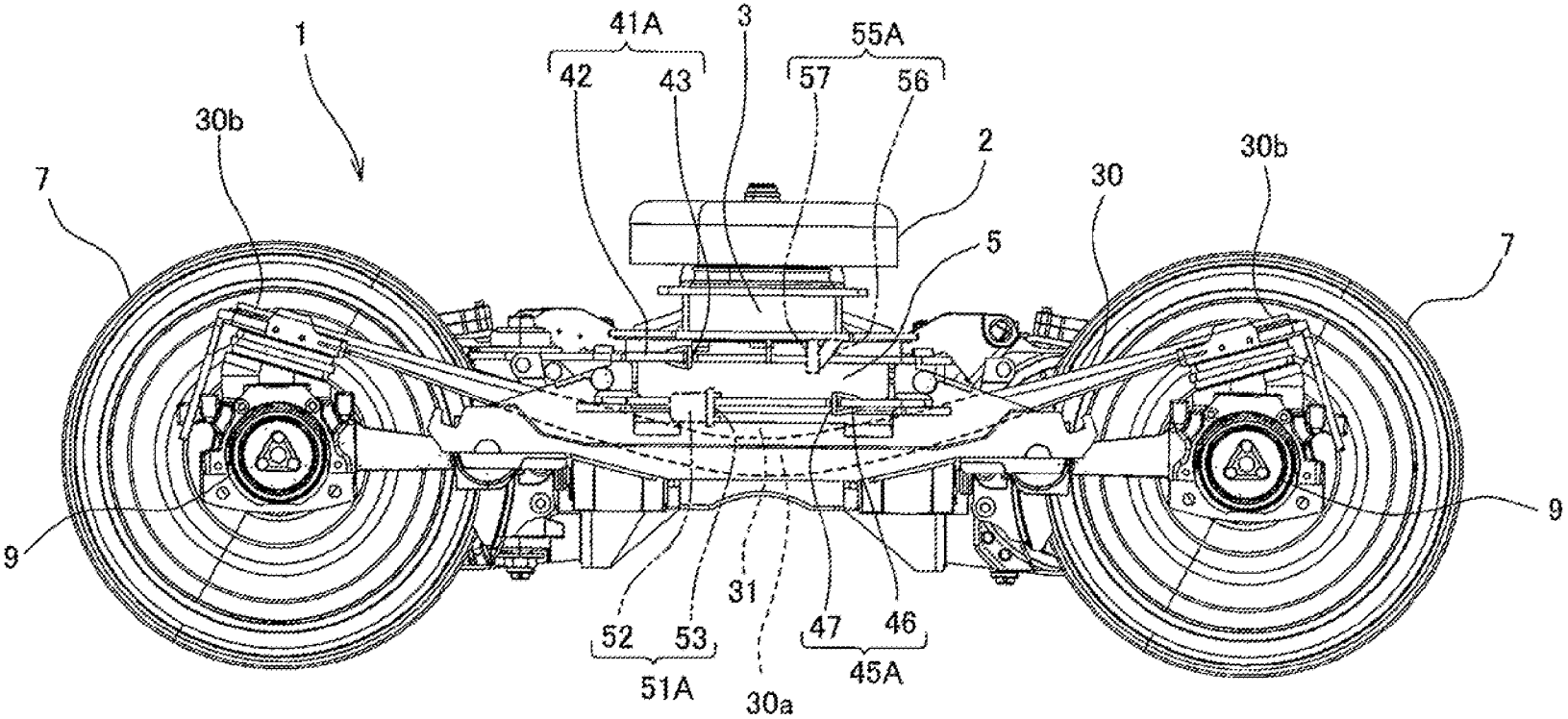
FIG. 7 is a side view showing a state where bolster anchors and brackets are detached from the bogie shown in FIG. 1.

FIG. 7 is a side view showing a state where the bolster anchors 12 and the brackets 21 are detached from the bogie shown in FIG. 1. As shown in FIG. 7, the pressing members 31 are provided on respective lower surfaces of both car width direction end portions of the cross beam 5. Each of the pressing members 31 is placed on the car longitudinal direction middle portion 30*a* of the plate springs 30 from above. The pressing member 31 does not support the lower surface of the plate spring 30, that is, the lower surface of the plate spring 30 is in an exposed state. In other words, the pressing member 31 is not fixed to the plate spring 30 in the upper/lower direction and presses the upper surface of the plate spring 30 downward so as to be separable from the upper surface of the plate spring 30. To be specific, the pressing of the pressing member 31 against the upper surface of the plate spring 30 is maintained by weight loads of the carbody (not shown), the bolster 3, the cross beam 5, and the like. When viewed from a lateral direction that is a direction (car width direction) perpendicular to the longitudinal direction of the plate spring 30, the lower surface of the pressing member 31 has a circular-arc shape that is convex downward, the lower surface pressing the plate spring 30. Similarly, when viewed from the lateral direction that is the direction (car width direction) perpendicular to the longitudinal direction of the plate spring 30, an upper surface of the middle portion 30*a* has a circular-arc shape that is convex downward, the upper surface being pressed by the pressing member 31.

The first stopper 41A is located on a trajectory of the movement of the second interference member 55A relative to the bogie frame 4, the trajectory being drawn when the bogie frame 4 rotates relative to the bolster 3 toward the first rotation side R1. The second stopper 45A is located on a trajectory of the movement of the first interference member 51A relative to the bogie frame 4, the trajectory being drawn when the bogie frame 4 rotates relative to the bolster 3 toward the second rotation side R2. The third stopper 41B is located on a trajectory of the movement of the fourth interference member 55B relative to the bogie frame 4, the trajectory being drawn when the bogie frame 4 rotates relative to the bolster 3 toward the second rotation side R2. The fourth stopper 45B is located on a trajectory of the movement of the third interference member 51B relative to the bogie frame 4, the trajectory being drawn when the bogie frame 4 rotates relative to the bolster 3 toward the first rotation side R1.

The first stopper 41A is located above a trajectory of the movement of the first interference member 51A relative to the bogie frame 4 so as to overlap the trajectory in a plan view, the trajectory being drawn when the bogie frame 4 rotates relative to the bolster 3 toward the first rotation side or the second rotation side. The second stopper 45A is located under a trajectory of the movement of the second interference member 55A relative to the bogie frame 4 so as to overlap the trajectory in a plan view, the trajectory being drawn when the bogie frame 4 rotates relative to the bolster 3 toward the first rotation side or the second rotation side. The third stopper 41B is located above a trajectory of the movement of the third interference member 51B relative to the bogie frame 4 so as to overlap the trajectory in a plan view, the trajectory being drawn when the bogie frame 4 rotates relative to the bolster 3 toward the first rotation side or the second rotation side. The fourth stopper 45B is located under a trajectory of the movement of the fourth interference member 55B relative to the bogie frame 4 so as to overlap the trajectory in a plan view, the trajectory being drawn when the bogie frame 4 rotates relative to the bolster 3 toward the first rotation side or the second rotation side.

At least the contact surfaces of the contact portions 43 and 47 of the first to fourth stoppers 41A, 41B, 45A, and 45B are arranged at a car width direction lateral side of the cross beam 5 so as to overlap the cross beam 5 in a side view. In the present embodiment, the base portions 42 and 46 and contact portions 43 and 47 of the first to fourth stoppers 41A, 41B, 45A, and 45B are arranged so as to overlap the cross beam 5 in a side view.

At least the contact surfaces of the contact portions 53 and 57 of the first to fourth interference members 51A, 51B, 55A, and 55B are arranged at a car width direction lateral side of the cross beam 5 so as to overlap the cross beam 5 in a side view when the bogie frame 4 is in a neutral state, that is, when the bogie frame 4 is located at a neutral position in the yawing direction relative to the bolster 3. In the present embodiment, the base portions 52 and 56 and contact portions 53 and 57 of the first to fourth interference members 51A, 51B, 55A, and 55B are arranged so as to overlap the cross beam 5 in a side view in the neutral state. The first stopper 41A is located above the first interference member 51A so as to overlap the first interference member 51A in a plan view in the neutral state, and the third stopper 41B is located above the third interference member 51B so as to overlap the third interference member 51B in a plan view in the neutral state. The neutral state denotes a state where a horizontal line perpendicular to a length direction of the cross beam 5 becomes parallel to the car longitudinal direction. In the present embodiment, the neutral state denotes a state where the length direction of the cross beam 5 and a length direction of the bolster 3 become parallel to each other.

According to the configuration explained above, when the bogie frame 4 rotates relative to the bolster 3 in the yawing direction to reach a predetermined rotation angle, the rotation range of the bogie frame 4 is appropriately restricted by the stoppers fixed to the bogie frame 4 and the interference members fixed to the bolster 3. More specifically, as shown in FIGS. 4 and 6, when the bogie frame 4 rotates relative to the bolster 3 toward the first rotation side R1 to reach the predetermined rotation angle, the first stopper 41A and the second interference member 55A contact each other, and at the same time, the fourth stopper 45B and the third interference member 51B contact each other. In contrast, when the bogie frame 4 rotates relative to the bolster 3 toward the second rotation side R2 to reach the predetermined rotation angle, the second stopper 45A and the first interference member 51A contact each other, and at the same time, the third stopper 41B and the fourth interference member 55B contact each other. As above, when the bogie frame 4 rotates toward any side, the rotation range can be appropriately restricted. Since the first to fourth stoppers 41A, 41B, 45A, and 45B are arranged at the car width direction lateral sides of the cross beam 5, a car width direction inner space of the bogie 1 can be efficiently utilized for the layout of the other parts. Therefore, the space efficiency can be improved. In this configuration, the first to fourth stoppers 41A, 41B, 45A, and 45B are arranged so as to overlap the cross beam 5 in a side view. With this, the first to fourth stoppers 41A, 41B, 45A, and 45B can be provided close to the cross beam 5 located at a center in the car longitudinal direction. Thus, the bogie 1 can be compactly configured while maintaining the balance and strength of the bogie 1. In the present embodiment, the base portions 42 and 46 each of which connects the cross beam 5 to the contact portion 43 or 47 can be prevented from becoming long in the car longitudinal direction, and the requirement of the strength of each of the first to fourth stoppers 41A, 41B, 45A, and 45B can be relaxed.

The first stopper 41A is located above the trajectory of the movement of the first interference member 51A relative to the bogie frame 4 so as to overlap the trajectory in a plan view, the trajectory being drawn when the bogie frame 4 rotates relative to the bolster 3 toward the first rotation side or the second rotation side. The third stopper 41B is located above the trajectory of the movement of the third interference member 51B relative to the bogie frame 4 so as to overlap the trajectory in a plan view, the trajectory being drawn when the bogie frame 4 rotates relative to the bolster 3 toward the first rotation side or the second rotation side. The second stopper 45A is located under the trajectory of the movement of the second interference member 55A relative to the bogie frame 4 so as to overlap the trajectory in a plan view, the trajectory being drawn when the bogie frame 4 rotates relative to the bolster 3 toward the first rotation side or the second rotation side. The fourth stopper 45B is located under the trajectory of the movement of the fourth interference member 55B relative to the bogie frame 4 so as to overlap the trajectory in a plan view, the trajectory being drawn when the bogie frame 4 rotates relative to the bolster 3 toward the first rotation side or the second rotation side. To be specific, a group of the first stopper 41A and the second interference member 55A and a group of the second stopper 45A and the first interference member 51A are arranged so as to be lined up in an upper/lower direction, and a group of the third stopper 41B and the fourth interference member 55B and a group of the fourth stopper 45B and the third interference member 51B are arranged so as to be lined up in the upper/lower direction. Therefore, while preventing these groups from occupying a large space in the car longitudinal direction, an allowable rotation range of the bogie frame 4 relative to the bolster 3 can be made adequately large. For example, in the present embodiment, an allowable rotation angle θ of the bogie frame 4 relative to the bolster 3 based on the neutral state is represented by θ1+θ2. To be specific, an entire allowable rotation angle from a rotation limit at the first rotation side until a rotation limit at the second rotation side is represented by 2θ (=2(θ1+θ2)). Further, when the bogie frame 4 is in the neutral state, that is, when the bogie frame 4 is located at the neutral position relative to the bolster 3 in the yawing direction, the first stopper 41A is located above the first interference member 51A so as to overlap the first interference member 51A in a plan view, and the third stopper 41B is located above the third interference member 51B so as to overlap the third interference member 51B in a plan view. Therefore, even if the bogie frame 4 is about to fall off from the bolster 3 when the bogie 1 is suspended by lifting up the bolster 3, the first interference member 51A and the third interference member 51B can receive the first stopper 41A and the third stopper 41B from below.

Second Embodiment

Figure 8:
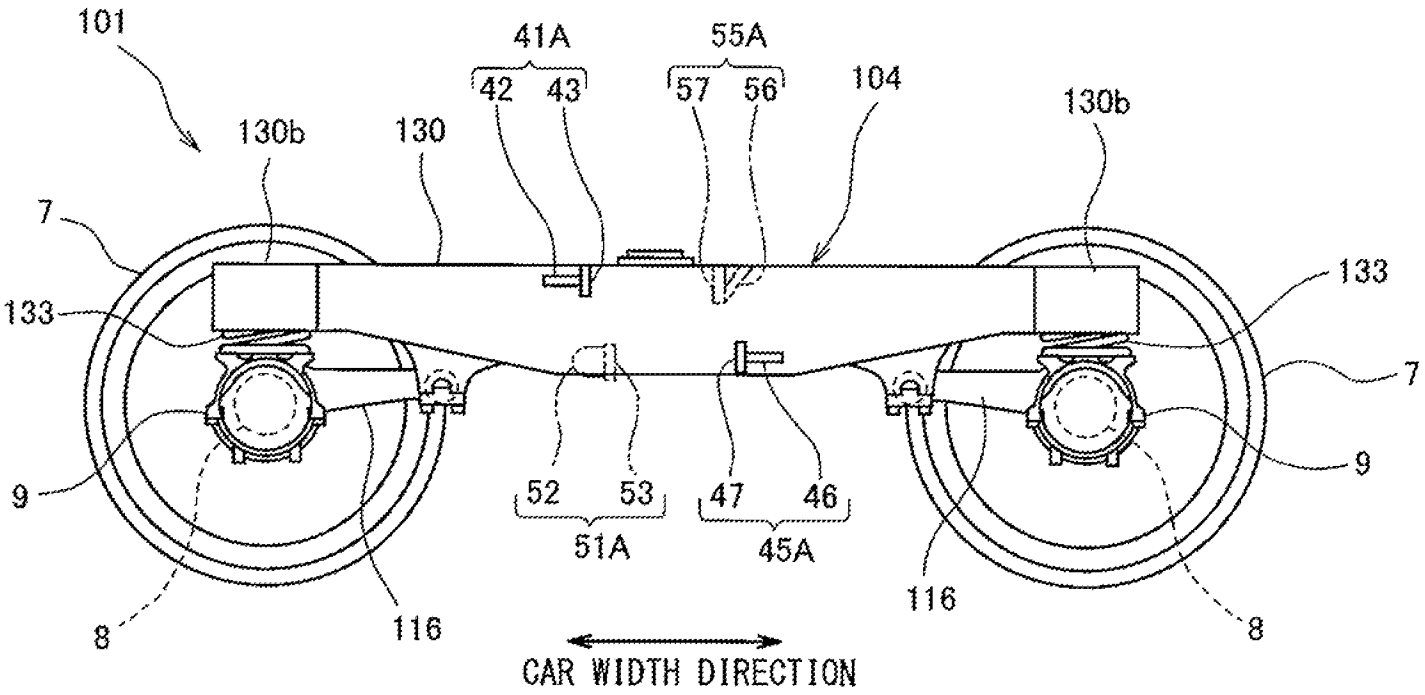
FIG. 8 is a side view showing the railcar bogie according to a second embodiment.
Figure 9:
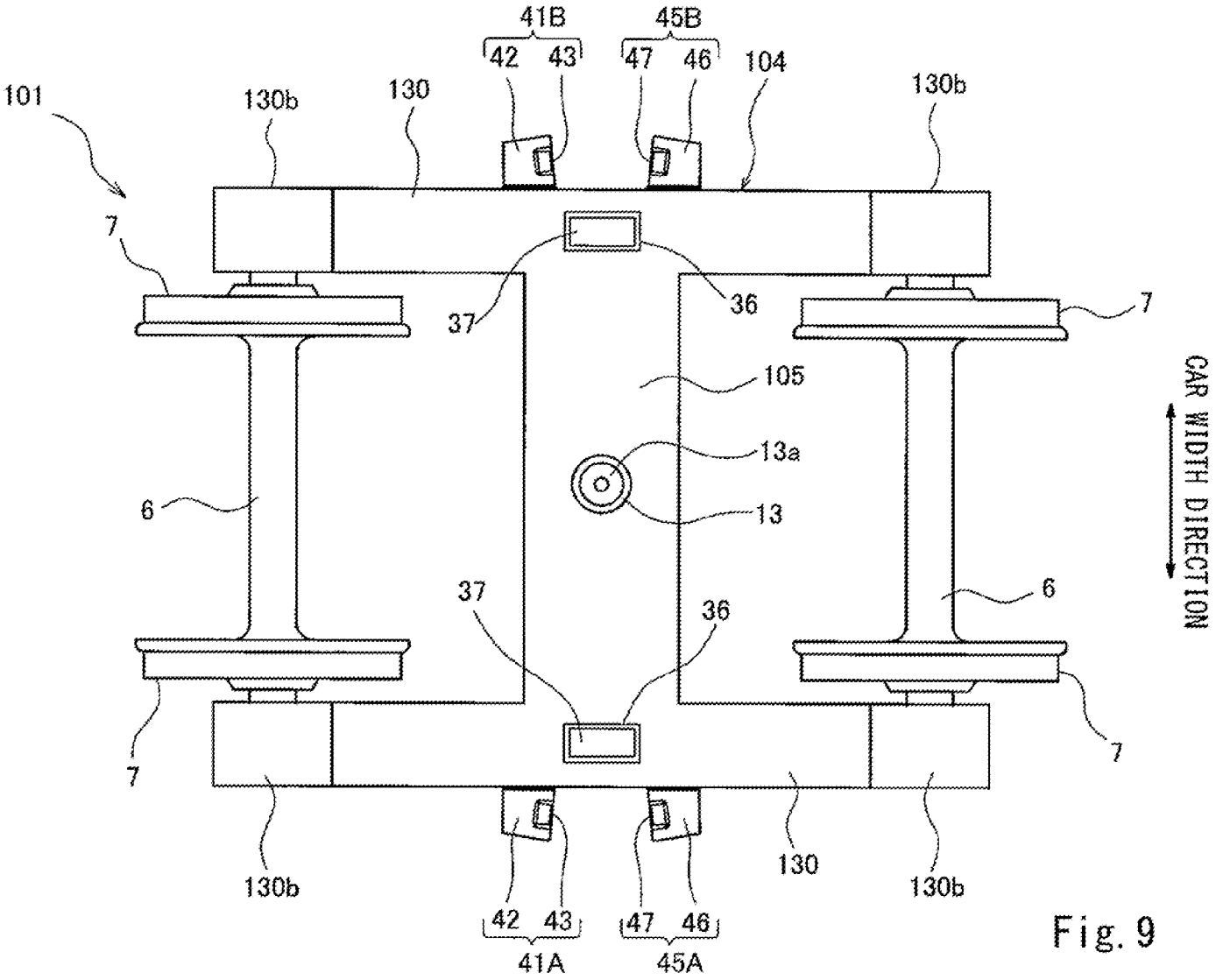
FIG. 9 is a plan view of the bogie shown in FIG. 8.

FIG. 8 is a side view showing a railcar bogie 101 according to the second embodiment. FIG. 9 is a plan view of the bogie 101 shown in FIG. 8. As shown in FIGS. 8 and 9, the bogie 101 of the second embodiment does not include the plate springs 30 as the side members. A bogie frame 104 of the second embodiment includes a pair of side sills 130 (side members) and a cross beam 105. The side sills 130 are located at both respective car width direction sides of the bogie frame 104 and extend in the car longitudinal direction. The cross beam 105 extends in the car width direction so as to couple car longitudinal direction middle portions, that is, forward/rearward direction middle portions of the side sills 130 to each other. The side sills 130 are fixed to the cross beam 105 by welding or the like, and the entire bogie frame 104 has an H shape in a plan view.

An axle box suspension 133 constituted by a coil spring (axle spring) is interposed between a car longitudinal direction end portion 130*b* of the side sill 130 and the axle box 9. An axle beam 116 extends integrally from the axle box 9 in the forward/rearward direction toward a center of the bogie. An end portion of the axle beam 116 is elastically coupled to the side sill 130 via a rubber bushing or the like. To be specific, the bogie 101 includes a so-called axle beam type axle box suspension. It should be noted that the axle box suspension may be an axle box suspension other than the axle beam type axle box suspension.

The first stopper 41A and the second stopper 45A are fixed at one of both car width direction sides to a region of the side sill 130 by welding or the like, the region overlapping the cross beam 105 in a side view. The first stopper 41A and the second stopper 45A according to the present embodiment are the same in the configuration and the positional relation as those according to the first embodiment. Therefore, the same reference signs are used. In a plan view, the first stopper 41A and the second stopper 45A are arranged within the range of the car longitudinal direction length of the cross beam 105. Similarly, the third stopper 45A and the fourth stopper 45B are fixed at the other car width direction side and are the same in the configuration and the positional relation as those according to the first embodiment. Although not shown, the bogie frame 104 supports the bolster 3 from below, the bolster 3 being the same as that of the first embodiment. The other components are the same as those of the first embodiment. Therefore, for example, the same reference signs are used for the same components, and detailed explanations thereof are omitted.

The present invention is not limited to the above embodiments, and modifications, additions, and eliminations may be made within the scope of the present invention. The above embodiments may be combined arbitrarily. For example, a part of components or methods in one embodiment may be applied to another embodiment.

For example, the above embodiment includes the first to fourth stoppers 41A, 41B, 45A, and 45B and the first to fourth interference members 51A, 51B, 55A, and 55B. However, any of the stoppers and the interference members which simultaneously contact each other at the first and second rotation sides R1 and R2 may be omitted. To be specific, the fourth stopper 45B and the third interference member 51B may be omitted. In such a case, at the first rotation side R1, the rotation range of the bogie frame 4 is restricted by the first stopper 41A and the second interference member 55A. Similarly, the first stopper 41A and the second interference member 55A may be omitted. In such a case, at the first rotation side R1, the rotation range of the bogie frame 4 is restricted by the fourth stopper 45B and the third interference member 41B. Similarly, at the second rotation side R2, any one of the group of the stopper and the interference member at one of both car width direction sides and the group of the stopper and the interference member at the other car width direction side may be omitted.

INDUSTRIAL APPLICABILITY

As above, the railcar bogie according to the present invention includes the above excellent effects. It is useful to widely apply the present invention to railcar bogies which can achieve the significance of the above effects.

REFERENCE SIGNS LIST

1, 101 bogie
3 bolster
4, 104 bogie frame
5, 105 cross beam
30 plate spring (side member)
41A first stopper
45A second stopper
41B third stopper
45B fourth stopper
51A first interference member
55A second interference member
51B third interference member
55B fourth interference member
130 side sill (side member)

The invention claimed is:

1. A bogie for supporting a carbody of a railcar,
the bogie comprising:
a bogie frame including a cross beam and side members and being rotatable relative to the carbody in a yawing direction, the cross beam extending in a car width direction, the side members supporting both respective car width direction end portions of the cross beam and extending in a car longitudinal direction; and
a stopper provided at the bogie frame and configured to contact an interference member to restrict a rotation range of the bogie frame when the bogie frame rotates relative to the carbody in the yawing direction, the interference member being connected to the carbody,
wherein when the bogie frame is located at a neutral position relative to the carbody in the yawing direction, the stopper is not in contact with the interference member and is arranged at a ear width direction lateral side of the cross beam so as to overlap the cross beam in a side view.

2. The railcar bogie according to claim 1, wherein the side members are plate springs which contact and support the respective ear width direction end portions of the cross beam from below.

3. The railcar bogie according to claim 1, further comprising a bolster which supports the carbody via air springs, wherein:
the bogie frame supports the bolster such that the bolster is rotatable relative to the bogie frame in the yawing direction, and
the interference member is provided at the bolster.

4. The railcar bogie according to claim 3, wherein:
a bracket, to which a bolster anchor is attached, is provided at a car width direction end portion of the bolster and projects downward from the bolster, and
the interference member is provided at a car width direction inner side of the bracket.

5. A bogie for supporting a carbody of a railcar,
the bogie comprising:
a bogie frame including a cross beam and side members and being rotatable relative to the carbody in a yawing direction, the cross beam extending in a car width direction, the side members supporting both respective car width direction end portions of the cross beam and extending in a car longitudinal direction; and
a stopper provided at the bogie frame and configured to contact an interference member to restrict a rotation range of the bogie frame when the bogie frame rotates relative to the carbody in the yawing direction, the interference member being connected to the carbody, wherein:
when the bogie frame is located at a neutral position relative to the carbody in the yawing direction, the stopper is arranged at a car width direction lateral side of the cross beam so as to overlap the cross beam in a side view;
the stopper comprises a plurality of stoppers;
the interference member comprises a plurality of interference members;
the plurality of stoppers includes a first stopper located at a first side in the car longitudinal direction and a second stopper located at a second side in the car longitudinal direction;
the first stopper is located above the second stopper;
the plurality of interference members includes a first interference member located at the first side in the car longitudinal direction and a second interference member located at the second side in the car longitudinal direction;
the first interference member is located under the second interference member;
the first stopper is located on a trajectory of a movement of the second interference member relative to the bogie frame, the trajectory being drawn when the bogie frame rotates relative to the carbody toward a first rotation side; and
the second stopper is located on a trajectory of a movement of the first interference member relative to the bogie frame, the trajectory being drawn when the bogie frame rotates relative to the carbody toward a second rotation side.

6. The railcar bogie according to claim 5, wherein the first stopper is located above a trajectory of the movement of the first interference member relative to the bogie frame so as to overlap the trajectory in a plan view, the trajectory being drawn when the bogie frame rotates relative to the carbody toward the first rotation side or the second rotation side.

7. The railcar bogie according to claim 5, wherein the second stopper is located under a trajectory of the movement of the second interference member relative to the bogie frame so as to overlap the trajectory in a plan view, the trajectory being drawn when the bogie frame rotates relative to the carbody toward the first rotation side or the second rotation side.

8. The railcar bogie according to claim 5, wherein when the bogie frame is located at the neutral position relative to the carbody in the yawing direction, the first stopper is located above the first interference member so as to overlap the first interference member in a plan view.

9. The railcar bogie according to claim 5, wherein the side members are plate springs which contact and support the respective car width direction end portions of the cross beam from below.

10. The railcar bogie according to according to claim 5, further comprising a bolster which supports the carbody via air springs, wherein:

the bogie frame supports the bolster such that the bolster is rotatable relative to the bogie frame in the yawing direction, and the interference member is provided at the bolster.

11. The railcar bogie according to according to claim 10, wherein:

a bracket, to which a bolster anchor is attached, is provided at a car width direction end portion of the bolster and projects downward from the bolster, and the interference member is provided at a car width direction inner side of the bracket.

* * * * *